US011713683B2

(12) United States Patent
Mizukami et al.

(10) Patent No.: US 11,713,683 B2
(45) Date of Patent: Aug. 1, 2023

(54) TURBINE BLADE AND METHOD FOR MANUFACTURING THE TURBINE BLADE

(71) Applicant: MITSUBISHI HEAVY INDUSTRIES, LTD., Tokyo (JP)

(72) Inventors: Satoshi Mizukami, Yokohama (JP); Masamitsu Kuwabara, Yokohama (JP); Satoshi Hada, Yokohama (JP); Saki Matsuo, Yokohama (JP); Yoshitaka Uemura, Yokohama (JP); Ryozo Tamura, Yokohama (JP); Yasumasa Kunisada, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/778,228

(22) PCT Filed: Mar. 23, 2021

(86) PCT No.: PCT/JP2021/011983
§ 371 (c)(1),
(2) Date: May 19, 2022

(87) PCT Pub. No.: WO2021/193628
PCT Pub. Date: Sep. 30, 2021

(65) Prior Publication Data

US 2022/0403744 A1 Dec. 22, 2022

(30) Foreign Application Priority Data

Mar. 25, 2020 (JP) ..... 2020-053739

(51) Int. Cl.
*F01D 5/18* (2006.01)

(52) U.S. Cl.
CPC ..... *F01D 5/186* (2013.01); *F05D 2220/32* (2013.01); *F05D 2230/10* (2013.01);
(Continued)

(58) Field of Classification Search
CPC ..... F01D 5/186; F05D 2260/202; F05D 2260/221
See application file for complete search history.

(56) References Cited

U.S. PATENT DOCUMENTS 3,628,880 A 12/1971 Smuland et al.
4,105,364 A 8/1978 Dodd
(Continued)

FOREIGN PATENT DOCUMENTS

JP 48-26086 8/1973
JP 50-23504 3/1975
(Continued)

OTHER PUBLICATIONS

International Search Report dated Apr. 27, 2021 in International Application No. PCT/JP2021/011983 with English translation.
(Continued)

*Primary Examiner* — Eldon T Brockman
(74) *Attorney, Agent, or Firm* — Wenderoth, Lind & Ponack, L.L.P.

(57) ABSTRACT

A turbine blade including an airfoil portion having a leading edge, a trailing edge, and a pressure surface and a suction surface extending between the leading edge and the trailing edge. The airfoil portion internally forming a cooling passage, which includes first and second cooling passages, and a plurality of outflow passages each having one end which opens to a merging portion formed by connecting an end portion of the first cooling passage on a side of the trailing edge and an end portion of the second cooling passage on the side of the trailing edge, and another end which opens to the trailing edge. The first cooling passage and the second cooling passage are divided by a partition member disposed in the airfoil portion. The cooling passage includes pressure
(Continued)

side pin fins in the first cooling passage, and suction side pin fins in the second cooling passage.

12 Claims, 7 Drawing Sheets

(52) U.S. Cl.
CPC .... *F05D 2240/30* (2013.01); *F05D 2260/202* (2013.01); *F05D 2260/221* (2013.01)

(56) References Cited

U.S. PATENT DOCUMENTS

| | | | | |
|---|---|---|---|---|
| 9,695,696 | B2 * | 7/2017 | Jones | B22C 9/24 |
| 2004/0151586 | A1 | 8/2004 | Chlus et al. | |
| 2010/0247290 | A1 | 9/2010 | Hada et al. | |
| 2015/0037165 | A1 * | 2/2015 | Jones | F01D 5/16 416/232 |
| 2015/0211376 | A1 | 7/2015 | Riley et al. | |
| 2016/0230593 | A1 | 8/2016 | Zelesky et al. | |
| 2017/0130591 | A1 | 5/2017 | Bunker | |
| 2018/0045056 | A1 * | 2/2018 | Wiedenhoefer | F02C 3/04 |
| 2018/0045058 | A1 | 2/2018 | Brzek et al. | |

FOREIGN PATENT DOCUMENTS

| | | |
|---|---|---|
| JP | 52-77914 | 6/1977 |
| JP | 58-197402 | 11/1983 |
| JP | 2-40001 | 2/1990 |
| JP | 3954034 | 8/2007 |
| JP | 2017-89630 | 5/2017 |
| WO | 2010/109954 | 9/2010 |

OTHER PUBLICATIONS

International Preliminary Report on Patentability dated Apr. 27, 2021 in International Application No. PCT/JP2021/011983 with English translation.

International Preliminary Report on Patentability dated Oct. 6, 2022 in International Application No. PCT/JP2021/011983 with English translation.

* cited by examiner

TURBINE BLADE AND METHOD FOR MANUFACTURING THE TURBINE BLADE

TECHNICAL FIELD

The present disclosure relates to a turbine blade and a method for manufacturing the turbine blade.

The present application claims priority on Japanese Patent Application No. 2020-53739 filed Mar. 25, 2020, the entire content of which is incorporated herein by reference.

BACKGROUND

It is known that in a turbine blade of a gas turbine or the like, a turbine blade exposed to a high-temperature gas flow is cooled by flowing a cooling fluid to a cooling passage formed in the turbine blade. For example, a cooling passage of a turbine blade disclosed in Patent Document 1 has a configuration in which the cooling passage is branched into a suction side cooling passage and a pressure side cooling passage by a partition member, and both the cooling passages are merged on a trailing edge side of the turbine blade to form a merging cooling passage.

CITATION LIST

Patent Literature

Patent Document 1: US Patent Application Publication No. 2018/0045058

SUMMARY

Technical Problem

In the turbine blade disclosed in Patent Document 1, a plurality of passages extending from a trailing edge to the merging cooling passage are formed, and in each of the suction side cooling passage, the pressure side cooling passage, and the merging cooling passage, a plurality of pin fins connecting facing inner surfaces defining the respective passages are formed. In manufacture of the turbine blade, if a plurality of passages are to be formed by machining or the like after a casting process of the turbine blade, a most downstream pin fin formed in the merging cooling passage may be damaged. Since such pin fins improve cooling efficiency of the turbine blade by tabulating a flow of a cooling fluid in the cooling passages, the damage to the pin fins may cause a problem of a risk of adversely affecting the cooling efficiency of the turbine blade.

In view of the above, an object of at least one embodiment of the present disclosure is to provide a turbine blade capable of efficient cooling and a method for manufacturing the turbine blade.

Solution to Problem

In order to achieve the above-described object, a turbine blade according to the present disclosure is a turbine blade that includes an airfoil portion which has a leading edge, a trailing edge, and a pressure surface and a suction surface extending between the leading edge and the trailing edge, the airfoil portion internally forming a cooling passage. The cooling passage includes a first cooling passage located closer to the pressure surface than the suction surface, a second cooling passage located closer to the suction surface than the pressure surface, and a plurality of outflow passages each having one end which opens to a merging portion formed by connecting an end portion of the first cooling passage on a side of the trailing edge and an end portion of the second cooling passage on the side of the trailing edge, and another end which opens to the trailing edge. The first cooling passage and the second cooling passage are divided by a partition member disposed in the airfoil portion. Only from an end portion of the partition member on the side of the trailing edge to a side of the leading edge, the cooling passage includes a plurality of pressure side pin fins each of which has one end connected to a pressure side wall including the pressure surface and another end connected to the partition member, in the first cooling passage, and a plurality of suction side pin fins each of which has one end connected to a suction side wall including the suction surface and another end connected to the partition member, in the second cooling passage.

Further, another turbine blade according to the present disclosure is a turbine blade that includes an airfoil portion which has a leading edge, a trailing edge, and a pressure surface and a suction surface extending between the leading edge and the trailing edge, the airfoil portion internally forming a cooling passage. The cooling passage includes a first cooling passage located closer to the pressure surface than the suction surface, a second cooling passage located closer to the suction surface than the pressure surface, and a plurality of outflow passages each having one end which opens to a merging portion formed by connecting an end portion of the first cooling passage on a side of the trailing edge and an end portion of the second cooling passage on the side of the trailing edge, and another end which opens to the trailing edge. The first cooling passage and the second cooling passage are divided by a partition member disposed in the airfoil portion. A suction side wall includes the suction surface, and a thickness of the suction side wall between the trailing edge and the end portion of the partition member on a side of the leading edge is larger than a thickness of the suction side wall between the leading edge and the end portion of the partition member on the side of the leading edge.

Further, a method for manufacturing a turbine blade according to the present disclosure is a method for manufacturing a turbine blade that includes an airfoil portion which has a leading edge, a trailing edge, and a pressure surface and a suction surface extending between the leading edge and the trailing edge, the airfoil portion internally forming a cooling passage, the cooling passage including a first cooling passage located closer to the pressure surface than the suction surface, a second cooling passage located closer to the suction surface than the pressure surface, and a plurality of outflow passages each having one end which opens to a merging portion formed by connecting an end portion of the first cooling passage on a side of the trailing edge and an end portion of the second cooling passage on the side of the trailing edge, and another end which opens to the trailing edge, the first cooling passage and the second cooling passage being divided by a partition member disposed in the airfoil portion, only from an end portion of the partition member on the side of the trailing edge to a side of the leading edge, the cooling passage including a plurality of pressure side pin fins each of which has one end connected to a pressure side wall including the pressure surface and another end connected to the partition member, in the first cooling passage, and a plurality of suction side pin fins each of which has one end connected to a suction side wall including the suction surface and another end connected to the partition member, in the second cooling passage, the method including a production step of producing the turbine blade, and a machining step of machining the plurality of outflow passages with respect to the airfoil portion, after the production step.

Advantageous Effects

According to the turbine blade of the present disclosure, since in the cooling passage, the pressure side pin fins and the suction side pin fins are provided only from the end portion of the partition member on the trailing edge side to the leading edge side and no pin fin is provided in the merging portion and the outflow passage, it is possible to reduce the risk of damaging the pin fins if the outflow passage is machined with respect to the airfoil portion after the airfoil portion is produced. Such pin fins improve cooling power of the turbine blade by tabulating the flow of the cooling fluid in the cooling passage, and if the risk of damaging the pin fins is reduced, the risk of adversely affecting the cooling efficiency of the turbine blade is reduced, making it possible to efficiently cool the turbine blade.

Further, since the internal pressure of the airfoil portion is higher than the external pressure of the airfoil portion on the suction surface side, a pressure in the expanding direction is applied to the suction side wall. By contrast, according to another turbine blade of the present disclosure, it is possible to increase the strength of the suction side wall, and it is possible to withstand such pressure.

According to the method for manufacturing the turbine blade of present disclosure, the cooling capacity can easily be adjusted by adjusting the inner diameter of the outflow passage, making it possible to increase design flexibility of the turbine blade.

DETAILED DESCRIPTION

Hereinafter, a turbine blade and a method for manufacturing the turbine blade according to embodiments of the present disclosure will be described with reference to the drawings. The embodiments each indicate one aspect of the present disclosure, do not intend to limit the disclosure, and can optionally be modified within a range of a technical idea of the present disclosure.

<Gas Turbine in which Turbine Blade of Present Disclosure is Used>

Figure 1:
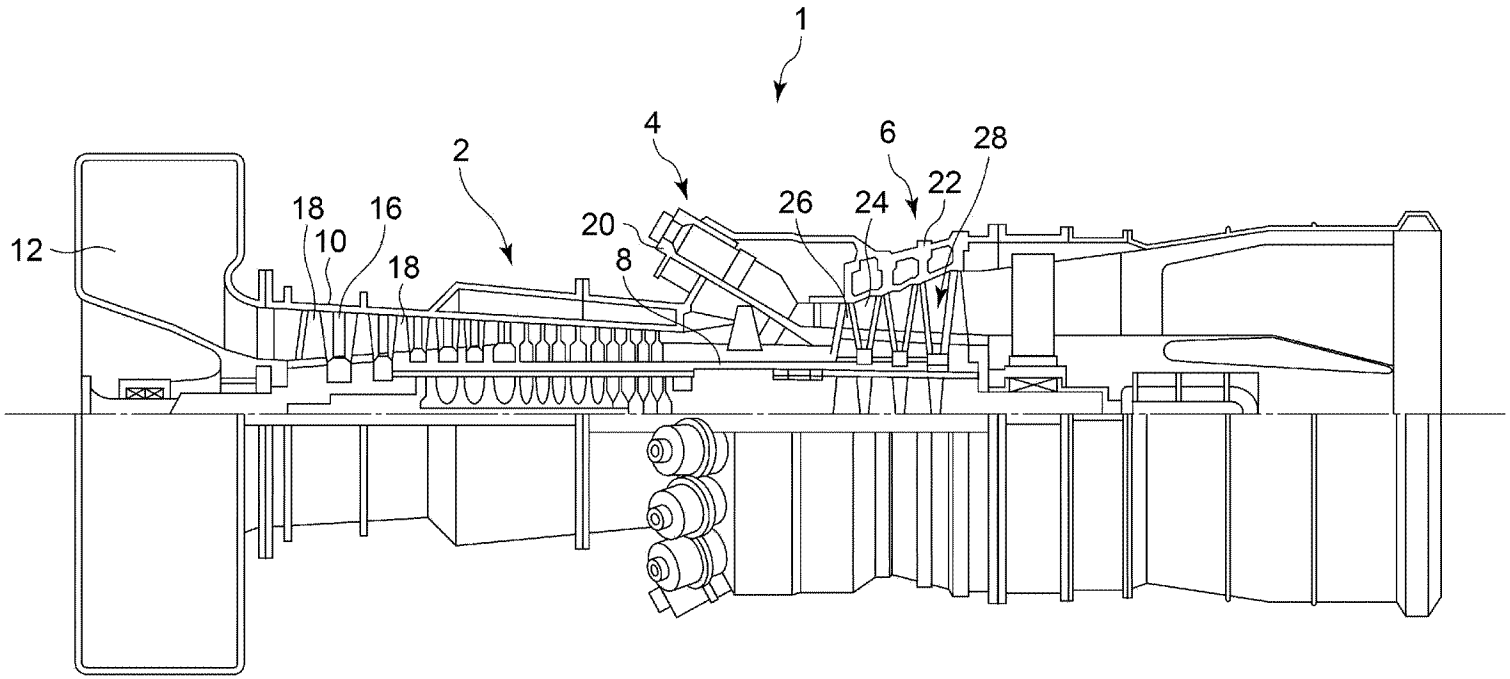
FIG. 1 is a schematic configuration view of a gas turbine in which a turbine blade is used according to an embodiment of the present disclosure.

As shown in FIG. 1, a gas turbine 1 includes a compressor 2 for generating compressed air, a combustor 4 for generating a combustion gas from the compressed air and fuel, and a turbine 6 configured to be rotary driven by the combustion gas. In the case of the gas turbine 1 for power generation, a generator (not shown) is connected to the turbine 6.

The compressor 2 includes a plurality of stator vanes 16 fixed to the side of a compressor casing 10 and a plurality of rotor blades 18 implanted on a rotor 8. Intake air from an air inlet 12 is sent to the compressor 2, and passes through the plurality of stator vanes 16 and the plurality of rotor blades 18 to be compressed, turning into compressed air having a high temperature and a high pressure.

The combustor 4 is supplied with fuel and the compressed air generated by the compressor 2. In the combustor 4, the fuel and the compressed air are mixed and then combusted to generate the combustion gas which serves as a working fluid of the turbine 6. A plurality of combustors 4 may be disposed in a casing 20 centering around the rotor along the circumferential direction.

The turbine 6 includes a combustion gas flow passage 28 formed in a turbine casing 22, and includes a plurality of stator vanes 24 and rotor blades 26 disposed in the combustion gas flow passage 28. Each of the stator vanes 24 is fixed to the side of the turbine casing 22. The plurality of stator vanes 24 arranged along the circumferential direction of the rotor 8 form stator vane rows. Moreover, each of the rotor blades 26 is implanted on the rotor 8. The plurality of rotor blades 26 arranged along the circumferential direction of the rotor 8 form rotor blade rows. The stator vane rows and the rotor blade rows are alternately arranged in the axial direction of the rotor 8.

<Turbine Blade of Present Disclosure>

The turbine blade of the present disclosure is intended for both the rotor blade 26 and the stator vane 24 of the turbine 6. Hereinafter, the turbine blade according to an embodiment of the present disclosure will be described as a stator vane 24, but the turbine blade may be the rotor blade 26.

Figure 2:
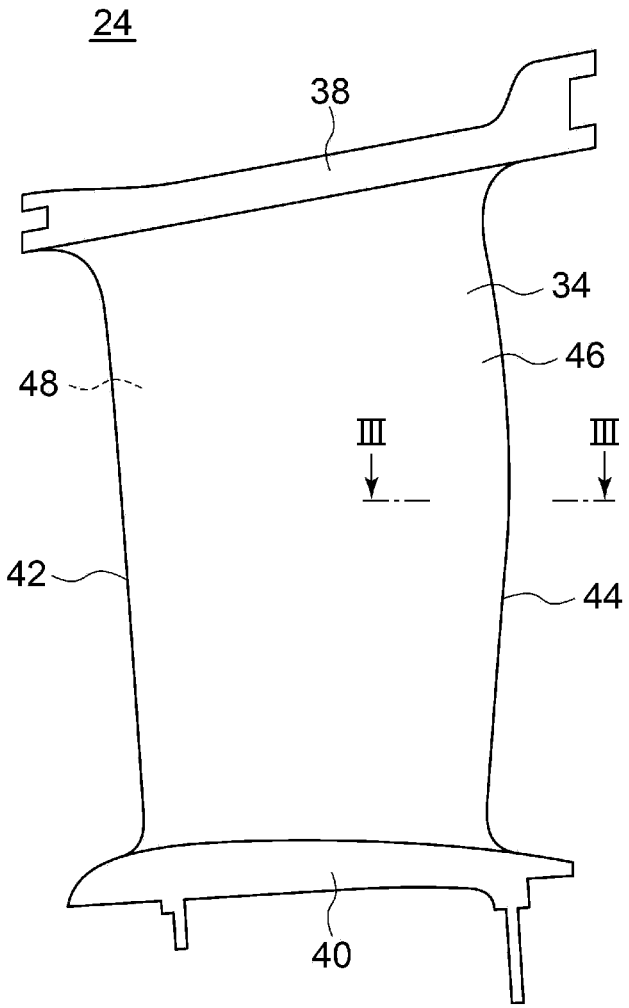
FIG. 2 is a view of the turbine blade as viewed in a direction from a pressure surface toward a suction surface according to an embodiment of the present disclosure.

As shown in FIG. 2, the stator vane 24 includes an airfoil portion 34, and the airfoil portion 34 extends in the blade height direction (spanwise direction), and has an outer shroud 38 and an inner shroud 40 disposed at both ends in the blade height direction. The airfoil portion 34 has a leading edge 42 and a trailing edge 44 extending along the blade height direction, and has a pressure surface 46 and a suction surface 48 extending between the leading edge 42 and the trailing edge 44.

Figure 3:
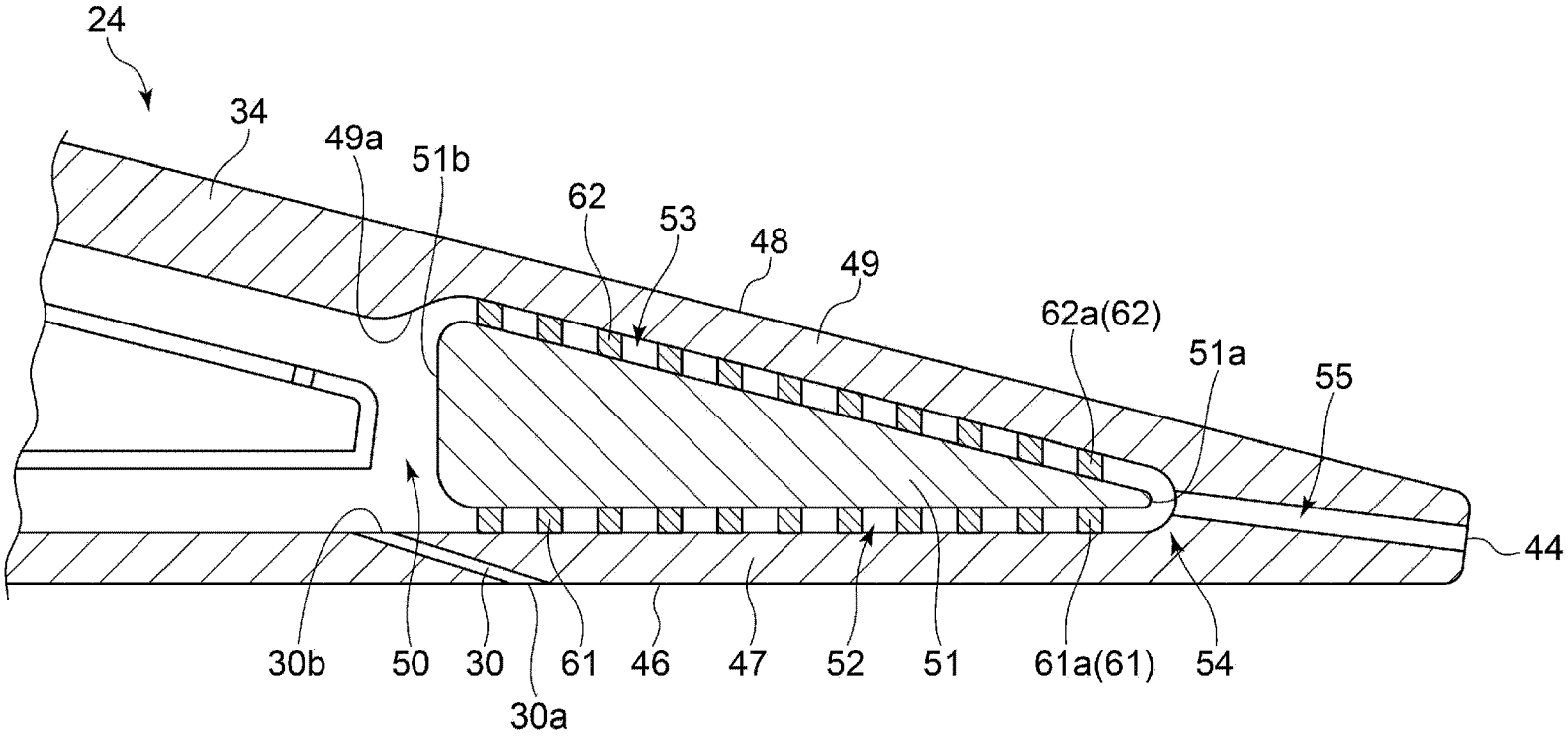
FIG. 3 is a cross-sectional view taken along the line of FIG. 2.

As shown in FIG. 3, the airfoil portion 34 internally forms a cooling passage 50 through which a cooling fluid (for example, air) for cooling the stator vane 24 flows. A partition member 51 is disposed inside the airfoil portion 34, that is, in the cooling passage 50, and a part of the cooling passage 50 is divided into a first cooling passage 52 and a second cooling passage 53. The first cooling passage 52 is located closer to the pressure surface 46 than the suction surface 48, and the second cooling passage 53 is located closer to the suction surface 48 than the pressure surface 46. The ends of the first cooling passage 52 and the second cooling passage 53 on the side of the trailing edge 44 are connected to each other to form a merging portion 54. The cooling passage 50 further includes a plurality of outflow passages 55 each of which has one end opening to the merging portion 54 and another end opening to the trailing edge 44. The outflow passage 55 may be a passage having any cross-sectional shape such as a circle or a rectangle, or may be in the form of a slit.

The first cooling passage 52 is provided with a plurality of pressure side pin fins 61 each of which has one end connected to a pressure side wall 47 including the pressure surface 46 and another end connected to the partition member 51. The second cooling passage 53 is provided with a plurality of suction side pin fins 62 each of which has one end connected to a suction side wall 49 including the suction surface 48 and another end connected to the partition member 51. Such pin fins are not provided in the merging portion 54 and the outflow passage 55.

Strictly speaking about the fact that the pin fins are not provided in the merging portion 54 and the outflow passage 55, an end portion 51*a* of the partition member 51 on the side of the trailing edge 44 is located closer to the side of the trailing edge 44 than both of a most downstream pressure side pin fin 61*a* located closest to the side of the trailing edge 44 among the pressure side pin fins 61 and a most downstream suction side pin fin 62*a* located closest to the side of the trailing edge 44 among the plurality of suction side pin fins 62, or is flush with a side surface of the most downstream pressure side pin fin 61*a* or the most downstream suction side pin fin 62*a*, whichever is closer to the trailing edge 44 (both, if a distance to the trailing edge 44 is the same).

With such arrangement of the pin fins, the following technical effects can be obtained. A method for manufacturing the stator vane 24 will be described later, but in a case where the outflow passage 55 is constituted by a plurality of flow passages small in inner diameter, so-called multi-hole, after casting the stator vane 24, the outflow passage 55 may be formed by machining or the like from the trailing edge 44 to the merging portion 54. In this case, since the stator vane 24 does not include the pin fins in the merging portion 54 and the outflow passage 55, it is possible to reduce the risk of damaging the pin fins when forming the outflow passage 55. Such pin fins (the pressure side pin fins 61 and the suction side pin fins 62) improve cooling efficiency of the stator vane 24 by tabulating the flow of the cooling fluid in the cooling passage 50, and if the risk of damaging the pin fins is reduced, the risk of adversely affecting the cooling efficiency of the stator vane 24 is reduced, making it possible to efficiently cool the stator vane 24.

If the pin fins are not provided in the merging portion 54 and the outflow passage 55, that is, the pressure side pin fins 61 and the suction side pin fins 62 are provided only from the end portion 51*a* of the partition member 51 on the side of the trailing edge 44 to the side of the leading edge 42 (see FIG. 2), the following further limitations can be added to the arrangement of the pressure side pin fins 61 and the suction side pin fins 62. Next, some such limitations and the technical effects obtained from those limitations will be described.

Figure 4:
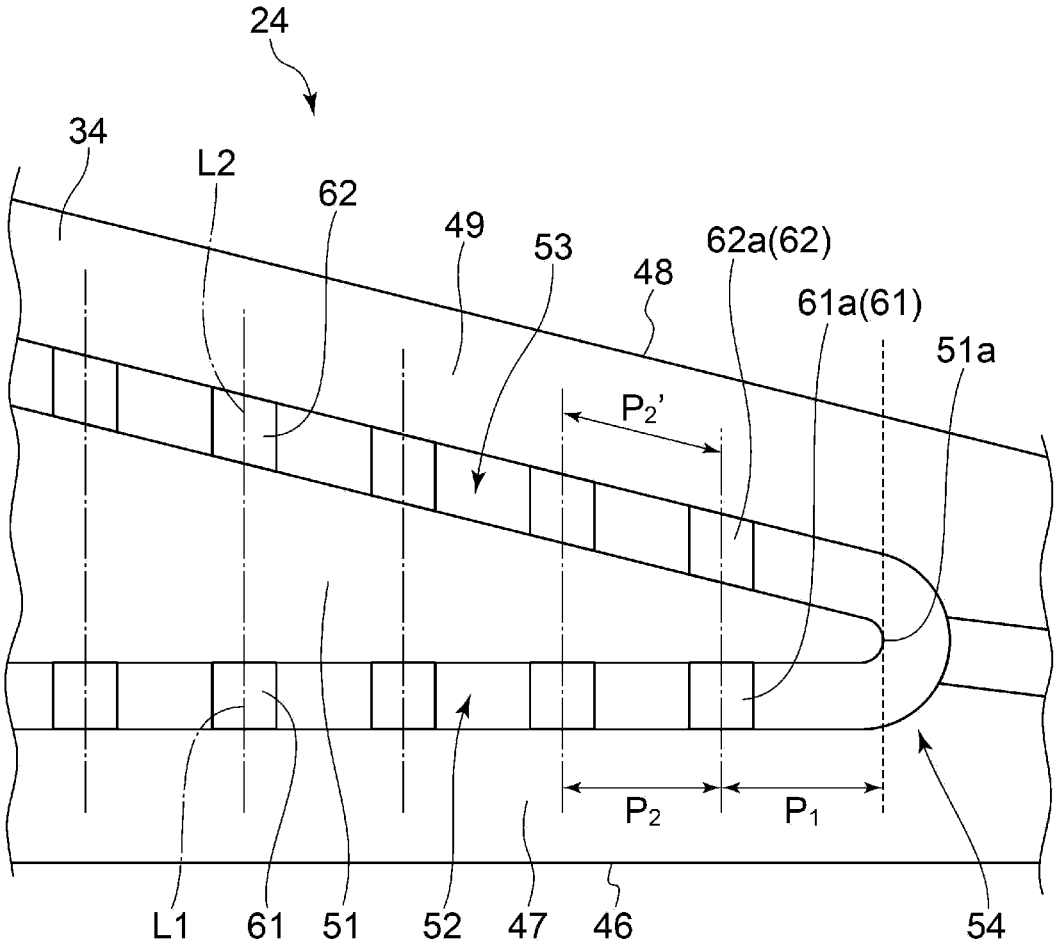
FIG. 4 is a cross-sectional view showing an example of arrangement of pressure side pin fins and suction side pin fins in the turbine blade according to an embodiment of the present disclosure.

As shown in FIG. 4, it is possible to cause a center line L1 of each of the plurality of pressure side pin fins 61 and a center line L2 of any one of the plurality of suction side pin fins 62 to coincide with each other. With such arrangement, it is possible to obtain the technical effects in manufacturing the stator vane 24. Hereinafter, such technical effects will be described.

Figure 5:
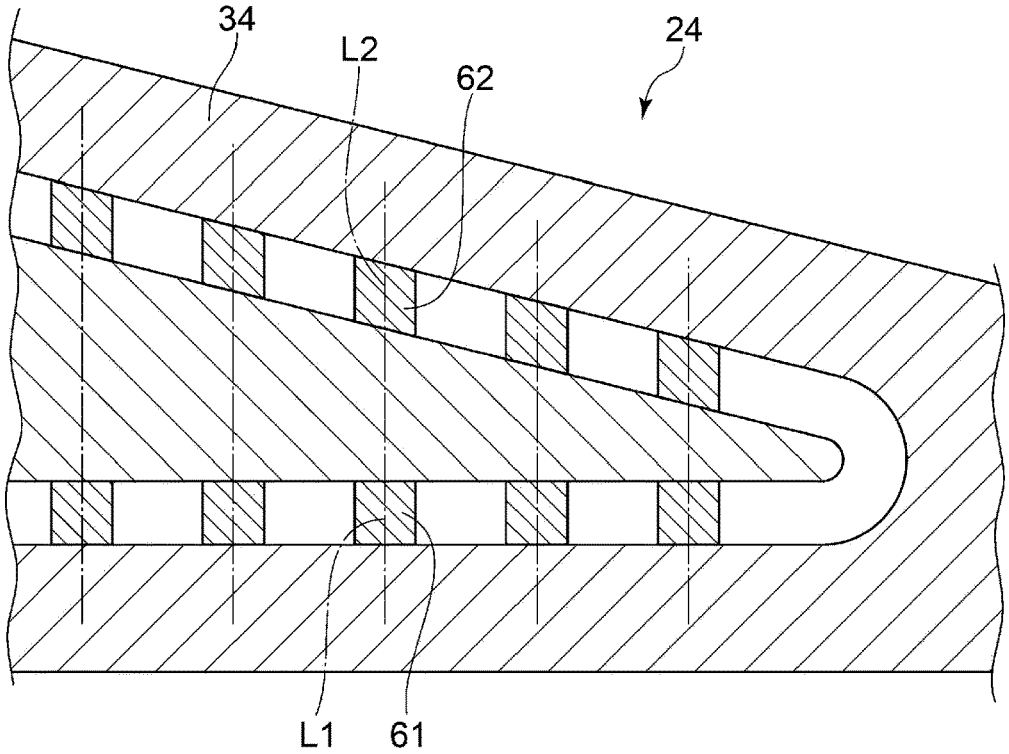
FIG. 5 shows respective cross-sectional views of the turbine blade and a core used in manufacturing the turbine blade according to an embodiment of the present disclosure.
Figure 5:
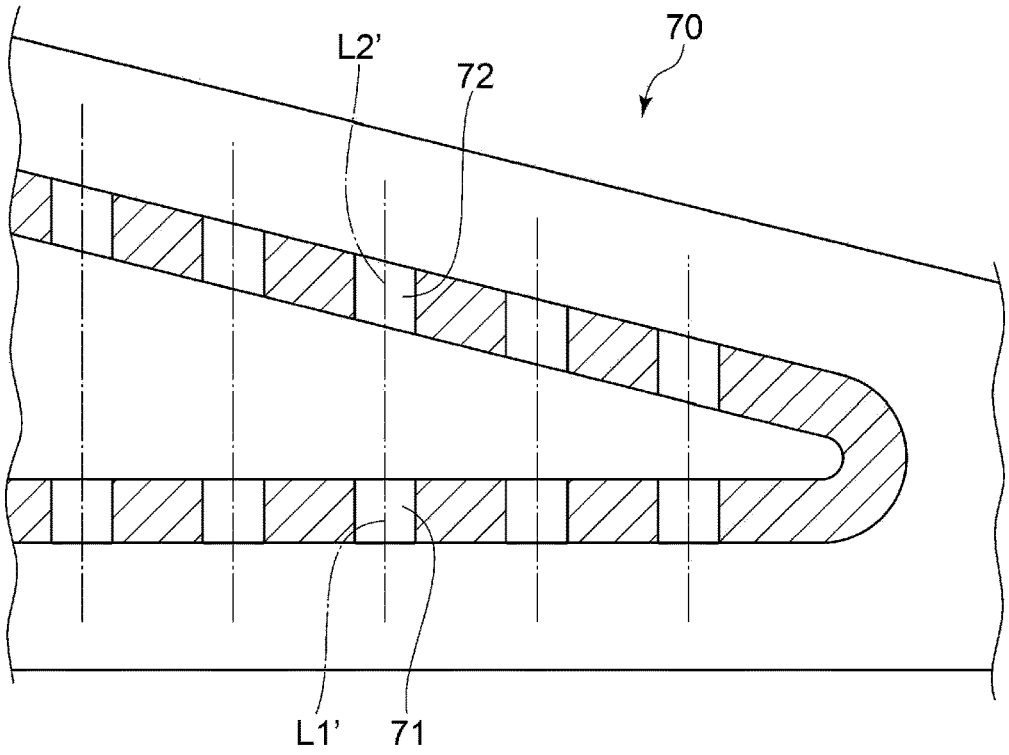

Upon casting the stator vane 24 including a hollow portion such as the cooling passage 50 in the airfoil portion 34, in general, a core 70 is required which is obtained by making the hollow portion of the stator vane 24 solid, as shown in FIG. 5. Since the stator vane 24 and the core 70 have a shape in which the hollow portion and the solid portion are inverted, the portions of the pressure side pin fin 61 and the suction side pin fin 62 in the stator vane 24 are, respectively, hollow portions 71 and 72 in the core 70. In FIG. 5, the solid portions are hatched and the hollow portions are outlined. In the core 70, a center line L1' of each of the plurality of hollow portions 71 respectively corresponding to the plurality of pressure side pin fins 61 and a center line L2' of any one of the plurality of hollow portions 72 respectively corresponding to the portions of the plurality of suction side pin fins 62 coincide with each other. Then, in an inspection after the core 70 is produced, by emitting light from one of the hollow portions 71 and 72 whose center lines coincide with each other, it is possible to see the light from the other hollow portion if there is no problem in the respective hollow portions 71, 72. Conversely, if there is a blockage anywhere of each hollow portion 71, 72, it is impossible to see the light from the other hollow portion. Thus, it is possible to improve inspection workability after producing the core 70.

Further, as shown in FIG. 4, from the side of the trailing edge 44 toward the side of the leading edge 42 (see FIG. 2), a pitch $P_2$ between the adjacent pressure side pin fins 61 and 61 can be made constant, as well as a pitch $P_2'$ between the adjacent suction side pin fins 62 and 62 can be made constant. This form may be combined with the above-described form in which the center lines L1 and L2 coincide with each other, or the center lines L1 and L2 may not coincide with each other.

The cooling efficiency of the stator vane 24 is to be improved by tabulating the flow of the cooling fluid flowing through each of the first cooling passage 52 and the second cooling passage 53 by the pressure side pin fins 61 and the suction side pin fins 62. However, while the cooling fluid flows between the adjacent pin fins, the turbulence of the cooling fluid flow is settled, and the flow is turbulated again by the next pin fin. Therefore, if a pitch between the adjacent pin fins is different, a section exists where the cooling efficiency is partially poor or good, causing a failure that a metal temperature distribution becomes non-uniform. By contrast, if the pin fins are disposed at appropriate and constant pitches, it is possible to reduce the risk of causing the section where the cooling efficiency is partially poor or good.

Further, as shown in FIG. 4, $0.5P_2<P_1<2P_2$ may hold, where $P_1$ is a pitch between the end portion 51*a* of the partition member 51 and the center lines of the most downstream pressure side pin fin 61*a* and the most downstream suction side pin fin 62*a* on the assumption that the center line L1 of each of the plurality of pressure side pin fins 61 and the center line L2 of any one of the plurality of suction side pin fins 62 coincide with each other and the pitch $P_2$ between the adjacent pressure side pin fins 61 and 61 and the pitch $P_2'$ between the adjacent suction side pin fins 62 and 62 are constant and $P_2=P_2'$.

With such configuration, the risk of damaging the pin fins is further reduced, making it possible to further reduce the risk of adversely affecting the cooling efficiency of the stator vane 24, and to cool the stator vane 24 more efficiently.

Further, although not shown, the arrangement of the pressure side pin fins 61 and the arrangement of the suction side pin fins 62 may be different. For example, the outer diameter of each pressure side pin fin 61 and the outer diameter of each suction side pin fin 62 may be different from each other, from the side of the trailing edge 44 (see FIG. 3) toward the side of the leading edge 42 (see FIG. 2), the pitch $P_2$ between the adjacent pressure side pin fins 61 and 61 and the pitch $P_2'$ between the adjacent suction side pin fins 62 and 62 may be different, or both of these features may be adopted. With such configuration, if the required cooling load is different between the side of the suction surface 48 and the side of the pressure surface 46, it is possible to cope with the respective cooling loads.

If the required cooling load is different between the side of the suction surface 48 and the side of the pressure surface 46, it is possible to cope with the respective cooling loads by a feature other than the arrangement of the pressure side pin fins 61 and the suction side pin fins 62. For example, as shown in FIG. 3, if the cooling load on side of the pressure surface 46 is larger than that on the side the suction surface 48, it is possible to provide a film hole 30, which has one end opens to the cooling passage 50 and another end opens to the pressure surface 46, in the airfoil portion 34. An opening portion 30*b* of the film hole 30 opening to the cooling passage 50 is located between the leading edge 42 (see FIG. 2) and an end portion 51*b* of the partition member 51 on the side of the leading edge 42, and an opening portion 30*a* of the film hole 30 opening to the pressure surface 46 is located between the trailing edge 44 and the opening portion 30*b*.

It is possible to reduce the cooling load of the cooling fluid flowing through the first cooling passage 52 by supplying the cooling fluid to the pressure surface 46 via the film hole 30 to directly decrease the temperature of the high-temperature gas flowing along the pressure surface 46. Thus, it is possible to eliminate the need to provide an additional configuration in the first cooling passage 52 in order to improve the cooling load of the cooling fluid flowing through the first cooling passage 52.

The configuration described below may be adopted with or independently of some configurations described above. As shown in FIG. 3, the thickness of the suction side wall 49 between the leading edge 42 and the end portion 51*b* of the partition member 51 on the side of the leading edge 42 (see FIG. 2) may be larger than the thickness of the suction side wall 49 between the trailing edge 44 and the end portion 51*b* of the partition member 51. That is, a transition region 49*a*, which is a region where the thickness of the suction side wall 49 increases in a direction from the trailing edge 44 toward the leading edge 42, may be provided on the side slightly closer to the side of the leading edge 42 than the end portion 51*b* of the partition member 51.

Generally, since the internal pressure of the airfoil portion 34 is higher than the external pressure of the airfoil portion 34 on the side of the suction surface 48, a pressure in the expanding direction is applied to the suction side wall 49. By contrast, with such configuration, it is possible to increase the strength of the suction side wall 49, and it is possible to withstand such pressure.

<Method for Manufacturing Turbine Blade of Present Disclosure>

Figure 6:
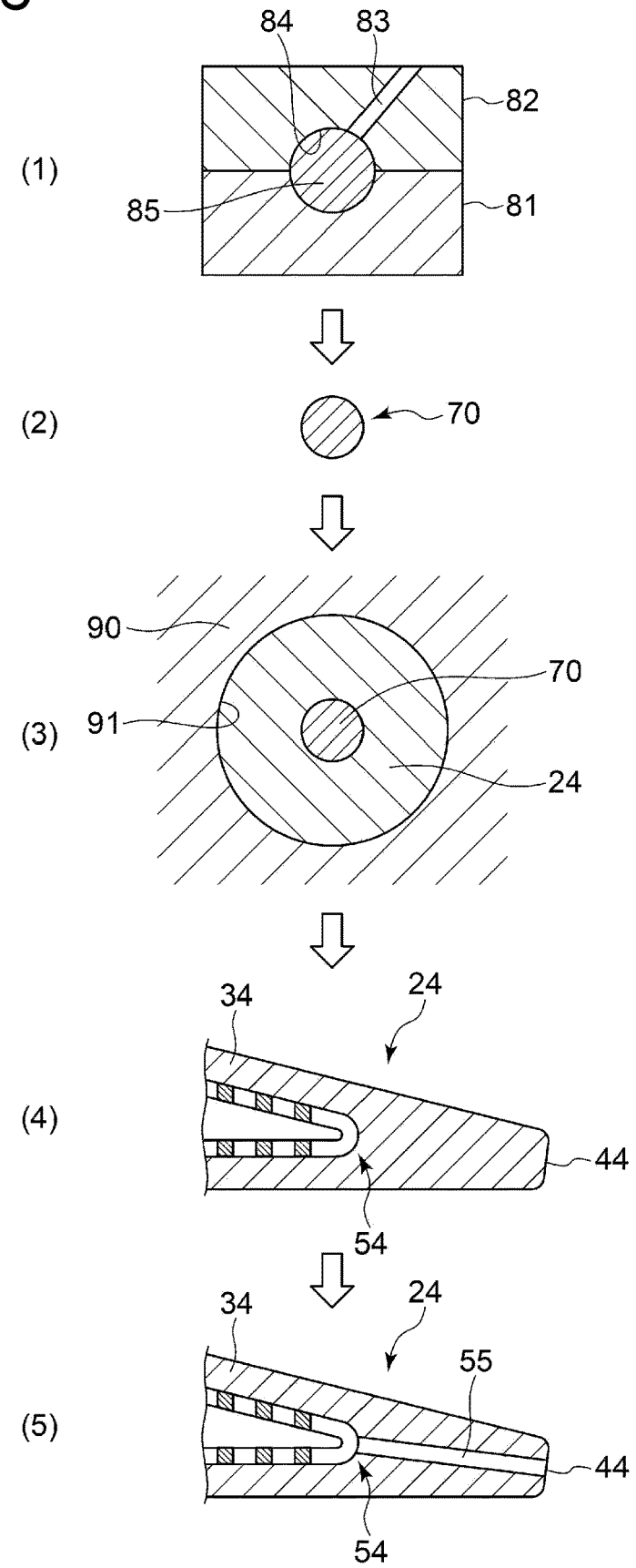
FIG. 6 is a schematic view showing steps of a method for manufacturing the turbine blade according to an embodiment of the present disclosure.

Next, a method for manufacturing the stator vane 24 will be described with reference to FIG. 6. FIG. 6 is a schematic view showing steps of the method for manufacturing the stator vane 24. In step (1), a ceramic material is injected into a space 84 defined by two molds 81 and 82 via a supply path 83 to produce a core precursor 85. In step (2), the core precursor 85 is fired to produce the core 70. In step (3), the stator vane 24 is cast by inserting the core 70 into an internal space 91 of a casting mold 90 and injecting a metal material into the internal space 91. In the stator vane 24, the portion corresponding to the core 70 becomes the hollow portion such as the cooling passage 50 (see FIG. 3). In step (4), the stator vane 24 is removed from the casting mold 90, and the core 70 is removed from the stator vane 24. In step (5), the plurality of outflow passages 55 are formed from the trailing edge 44 to the merging portion 54 by machining or the like.

In this method, steps (1) to (4) can be referred to as a production step of producing the airfoil portion 34, and step (5) can be referred to as a machining step of machining the plurality of outflow passages 55 with respect to the airfoil portion 34. If the stator vane 24 is manufactured by the method including such steps, the cooling capacity of the stator vane 24 can easily be adjusted by adjusting the inner diameter of each outflow passage 55, making it possible to increase design flexibility of the stator vane 24.

Figure 7:
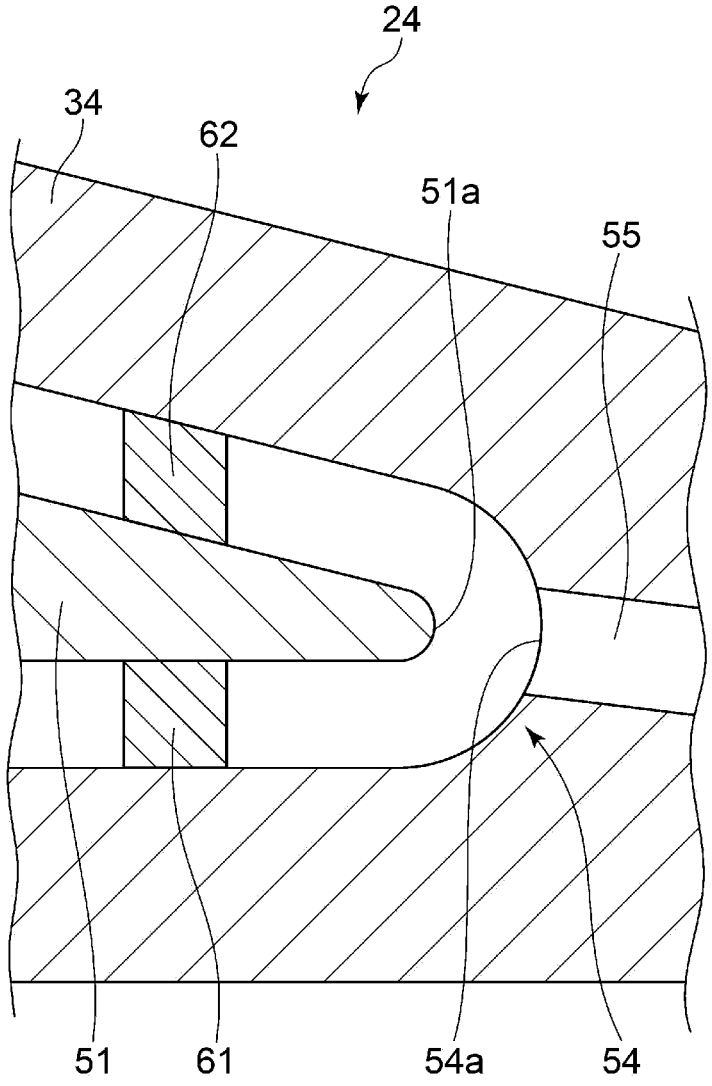
FIG. 7 is an enlarged cross-sectional view of a part of the inside of an airfoil of the turbine blade according to an embodiment of the present disclosure.

As shown in FIG. 7, the merging portion 54 is defined by the end portion 51*a* of the partition member 51 and a passage inner surface 54*a* facing the end portion 51*a*, and each of the end portion 51*a* of the partition member 51 and the passage inner surface 54*a* preferably has a rounded shape (curved surface).

As described above, the core, which is used when the product internally including the hollow portion is cast, has a form in which the solid portion and the hollow portion in the product are inverted. Thus, the core 70 (see FIG. 6), which is used when the stator vane 24 is cast, includes a solid portion with a shape corresponding to the merging portion 54 which is the hollow portion in the stator vane 24. If the end portion 51*a* of the partition member 51 is sharp, there may be a problem in injectability of the metal material into the mold at the time of casting. On the other hand, if the passage inner surface 54*a* is sharp, there may be a problem in injectability of a raw material of the core into the mold at the time of producing the core 70. By contrast, since the end portion 51*a* of the partition member 51 and the passage inner surface 54*a* both have the rounded shapes if the merging portion 54 has the above-described configuration, it is possible to avoid deterioration in injectability of the metal material and the raw material of the core at the time of casting and at the time of producing the core.

The contents described in the above embodiments would be understood as follows, for instance.

[1] A turbine blade according to one aspect is a turbine blade (stator vane 24, rotor blade 26) that includes an airfoil portion (34) which has a leading edge (42), a trailing edge (44), and a pressure surface (46) and a suction surface (48) extending between the leading edge (42) and the trailing edge (48), the airfoil portion (34) internally forming a cooling passage (50). The cooling passage (50) includes a first cooling passage (52) located closer to the pressure surface (46) than the suction surface (48), a second cooling passage (53) located closer to the suction surface (48) than the pressure surface (46), and a plurality of outflow passages (55) each having one end which opens to a merging portion (54) formed by connecting an end portion of the first cooling passage (52) on a side of the trailing edge (44) and an end portion of the second cooling passage (53) on the side of the trailing edge (44), and another end which opens to the trailing edge (44). The first cooling passage (52) and the second cooling passage (53) are divided by a partition member (51) disposed in the airfoil portion (34). Only from an end portion (51*a*) of the partition member (51) on the side of the trailing edge (44) to a side of the leading edge (44), the cooling passage (50) includes a plurality of pressure side pin fins (61) each of which has one end connected to a pressure side wall (47) including the pressure surface (46) and another end connected to the partition member (51), in the first cooling passage (52), and a plurality of suction side pin fins (62) each of which has one end connected to a suction side wall (49) including the suction surface (48) and another end connected to the partition member (51), in the second cooling passage (53).

According to the turbine blade of the present disclosure, since in the cooling passage, the pressure side pin fins and the suction side pin fins are provided only from the end portion of the partition member on the trailing edge side to the leading edge side and no pin fin is provided in the merging portion and the outflow passage, it is possible to reduce the risk of damaging the pin fins if the outflow passage is machined with respect to the airfoil portion after the airfoil portion is produced. Such pin fins improve cooling power of the turbine blade by tabulating the flow of the cooling fluid in the cooling passage, and if the risk of damaging the pin fins is reduced, the risk of adversely affecting the cooling efficiency of the turbine blade is reduced, making it possible to efficiently cool the turbine blade.

[2] A turbine blade according to another aspect is the turbine blade as defined in [1], where a center line (L1) of each of the plurality of pressure side pin fins (61) and a center line (L2) of any one of the plurality of suction side pin fins (62) coincide with each other.

Upon casting the turbine blade with such configuration, a core is required which is obtained by making the hollow portion of the turbine blade solid. Since the turbine blade and the core have the shape in which the hollow portion and the solid portion are inverted, the portions of the pressure side pin fin and the suction side pin fin in the turbine blade are, respectively, hollow portions in the core. With the above configuration [2], in the core, the center line of each of the plurality of hollow portions respectively corresponding to the plurality of pressure side pin fins and the center line of any one of the plurality of hollow portions respectively corresponding to the portions of the plurality of suction side pin fins coincide with each other. Then, in the inspection after the core is produced, by emitting light from one of the hollow portions whose center lines coincide with each other, it is possible to see the light from the other hollow portion if there is no problem in the respective hollow portions. Conversely, if there is a blockage anywhere of each hollow portion, it is impossible to see the light from the other hollow portion. Thus, it is possible to improve inspection workability after producing the core.

[3] A turbine blade according to still another aspect is the turbine blade as defined in [1] or [2], where, from the side of the trailing edge (44) toward the side of the leading edge (42), a pitch ($P_2$) between adjacent pressure side pin fins (61, 61) is constant, as well as a pitch ($P_2'$) between adjacent suction side pin fins (62, 62) is constant.

The cooling efficiency of the turbine blade is to be improved by tabulating the flow of the cooling fluid flowing through each of the cooling passages by the pin fins. However, while the cooling fluid flows between the adjacent pin fins in the flow direction of the cooling fluid, the turbulence of the cooling fluid flow is settled, and the flow is turbulated again by the next pin fin. Therefore, if a pitch between the adjacent pin fins is different, a section exists where the cooling efficiency is partially poor or good, causing a failure that a metal temperature distribution becomes non-uniform. By contrast, if the pin fins are disposed at appropriate and constant pitches, it is possible to reduce the risk of causing the section where the cooling efficiency is partially poor or good.

[4] A turbine blade according to yet another aspect is the turbine blade as defined in any one of [1] to [3], where, the end portion (51*a*) of the partition member (51) on the side of the trailing edge (44) is located closer to the side of the trailing edge (44) than both of a most downstream pressure side pin fin (61*a*) located closest to the side of the trailing edge (44) among the plurality of pressure side pin fins (61) and a most downstream suction side pin fin (62*a*) located closest to the side of the trailing edge (44) among the plurality of suction side pin fins (62).

With such configuration, the risk of damaging the pin fins is further reduced, making it possible to further reduce the risk of adversely affecting the cooling efficiency of the turbine blade, and to cool the turbine blade more efficiently.

[5] A turbine blade according to yet another aspect is the turbine blade as defined in [4], where a center line (L1) of each of the plurality of pressure side pin fins (61) and a center line (L2) of any one of the plurality of suction side pin fins (62) coincide with each other, from the side of the trailing edge (44) toward the side of the leading edge (42), a pitch ($P_2$) between adjacent pressure side pin fins (61, 61) is constant, as well as a pitch ($P_2'$) between adjacent suction side pin fins (62, 62) is constant, and the both pitches are the same, and $0.5P_2<P_1<2P_2$ holds, where $P_1$ is a pitch between the end portion (51*a*) of the partition member (51) on the side of the trailing edge (44) and the center lines (L1, L2) of the most downstream pressure side pin fin (61*a*) and the most downstream suction side pin fin (62*a*) and $P_2$ is a pitch between the adjacent pressure side pin fins (61, 61) and a pitch between the adjacent suction side pin fins (62, 62).

With such configuration, as compared with the above configuration [4], the risk of damaging the pin fins is further reduced, making it possible to further reduce the risk of adversely affecting the cooling efficiency of the turbine blade, and more efficient cooling is possible.

[6] A turbine blade according to yet another aspect is the turbine blade as defined in [1], where an outer diameter of each of the pressure side pin fins (61) and an outer diameter of each of the suction side pin fins (62) are different, or from the side of the trailing edge (44) toward the side of the leading edge (42), a pitch ($P_2$) between adjacent pressure side pin fins (61, 61) and a pitch ($P_2'$) between adjacent suction side pin fins (62, 62) are different.

With such configuration, if the cooling load is different between the suction surface side and the pressure surface side, it is possible to cope with the respective required cooling loads.

[7] A turbine blade according to yet another aspect is the turbine blade as defined in any one of [1] to [6], where the merging portion (54) is defined by the end portion (51*a*) of the partition member (51) on the side of the trailing edge (44) and a passage inner surface (54*a*) facing the end portion (51*a*), and the end portion (51*a*) of the partition member (51) on the side of the trailing edge (44) and the passage inner surface (54*a*) each have a rounded shape.

If the end portion of the partition member on the trailing edge side is sharp, there may be a problem in injectability of a metal material into the mold at the time of casting, and if the passage inner surface is sharp, there may be a problem in injectability of a raw material of the core into the mold at the time of producing the core. By contrast, in the above configuration [7], since the end portion of the partition member and the passage inner surface both have the rounded shapes, it is possible to avoid deterioration in injectability of the metal material and the raw material of the core at the time of casting and at the time of producing the core.

[8] A turbine blade according to yet another aspect is the turbine blade as defined in any one of [1] to [7], where a thickness of the suction side wall (49) between the leading edge (42) and the end portion (51*b*) of the partition member (51) on the side of the leading edge (42) is larger than a thickness of the suction side wall (49) between the trailing edge (44) and the end portion (51*b*) of the partition member (51) on the side of the leading edge (42).

Since the internal pressure of the airfoil portion is higher than the external pressure of the airfoil portion on the suction surface side, a pressure in the expanding direction is applied to the suction side wall. By contrast, with the above configuration [8], it is possible to increase the strength of the suction side wall, and it is possible to withstand such pressure.

[9] A turbine blade according to one aspect is a turbine blade (stator vane 24, rotor blade 26) that includes an airfoil portion (34) which has a leading edge (42), a trailing edge (44), and a pressure surface (46) and a suction surface (48) extending between the leading edge (42) and the trailing edge (48), the airfoil portion (34) internally forming a cooling passage (50). The cooling passage (50) includes a first cooling passage (52) located closer to the pressure surface (46) than the suction surface (48), a second cooling passage (53) located closer to the suction surface (48) than the pressure surface (46), and a plurality of outflow passages (55) each having one end which opens to a merging portion (54) formed by connecting an end portion of the first cooling passage (52) on a side of the trailing edge (44) and an end portion of the second cooling passage (53) on the side of the trailing edge (44), and another end which opens to the trailing edge (44). The first cooling passage (52) and the second cooling passage (53) are divided by a partition member (51) disposed in the airfoil portion (34). A suction side wall (49) includes the suction surface (48), and a thickness of the suction side wall (49) between the leading edge (42) and the end portion (51*b*) of the partition member (51) on a side of the leading edge (42) is larger than a thickness of the suction side wall (49) between the trailing edge (44) and the end portion (51*b*) of the partition member (51) on the side of the leading edge (42).

Since the internal pressure of the airfoil portion is higher than the external pressure of the airfoil portion on the suction surface side, a pressure in the expanding direction is applied to the suction side wall. By contrast, according to the turbine blade of the present disclosure, it is possible to increase the strength of the suction side wall, and it is possible to withstand such pressure.

[10] A turbine blade according to yet another aspect is the turbine blade as defined in any one of [1] to [9], where the airfoil portion is provided with a film hole (30) which has one end opening to the cooling passage (50) and another end opening to the pressure surface (46), and an opening portion (30*b*) of the film hole (30) opening to the cooling passage (50) is located between the leading edge (42) and an end portion (51*b*) of the partition member (51) on the side of the leading edge (42).

If the cooling load is larger in the pressure surface side than in the suction surface side, it is possible to reduce the cooling load of the cooling fluid flowing through the first cooling passage by supplying the cooling fluid to the pressure surface via the film hole to directly decrease the temperature of the high-temperature gas flowing along the pressure surface. Thus, it is possible to eliminate the need to provide an additional configuration in the first cooling passage in order to improve the cooling load of the cooling fluid flowing through the first cooling passage.

[11] A method for manufacturing a turbine blade according to one aspect is a method for manufacturing a turbine blade (stator vane 24, rotor blade 26) that includes an airfoil portion (34) which has a leading edge (42), a trailing edge (44), and a pressure surface (46) and a suction surface (48) extending between the leading edge (42) and the trailing edge (48), the airfoil portion (34) internally forming a cooling passage (50), the cooling passage (50) including a first cooling passage (52) located closer to the pressure surface (46) than the suction surface (48), a second cooling passage (53) located closer to the suction surface (48) than the pressure surface (46), and a plurality of outflow passages (55) each having one end which opens to a merging portion (54) formed by connecting an end portion of the first cooling passage (52) on a side of the trailing edge (44) and an end portion of the second cooling passage (53) on the side of the trailing edge (44), and another end which opens to the trailing edge (44), the first cooling passage (52) and the second cooling passage (53) being divided by a partition member (51) disposed in the airfoil portion (34), only from an end portion (51*a*) of the partition member (51) on the side of the trailing edge (44) to a side of the leading edge (44), the cooling passage (50) including a plurality of pressure side pin fins (61) each of which has one end connected to a pressure side wall (47) including the pressure surface (46) and another end connected to the partition member (51), in the first cooling passage (52), and a plurality of suction side pin fins (62) each of which has one end connected to a suction side wall (49) including the suction surface (48) and another end connected to the partition member (51), in the second cooling passage (53), the method including a production step of producing the turbine blade (24, 26), and a machining step of machining the plurality of outflow passages (55) with respect to the airfoil portion (34), after the production step.

According to the method for manufacturing the turbine blade of present disclosure, the cooling capacity can easily be adjusted by adjusting the inner diameter of the outflow passage, making it possible to increase design flexibility of the turbine blade.

REFERENCE SIGNS LIST

24 Stator vane (turbine blade)
26 Rotor blade (turbine blade)
30 Film hole
30*b* Opening portion (of film hole)
34 Airfoil portion
42 Leading edge
44 Trailing edge
46 Pressure surface
47 Pressure side wall
48 Suction surface
49 Suction side wall
50 Cooling passage
51 Partition member
51*a* End portion (of partition member on trailing edge side)
51*b* End portion (of partition member on leading edge side)
52 First cooling passage
53 Second cooling passage
54 Merging portion
54*a* Passage inner surface (of merging portion)
55 Outflow passage
61 Pressure side pin fin
61*a* Most downstream pressure side pin fin
62 Suction side pin fin
62*a* Most downstream suction side pin fin
L1 Center line (of pressure side pin fin)
L2 Center line (of suction side pin fin)

The invention claimed is:

1. A turbine blade comprising an airfoil portion which has a leading edge, a trailing edge, and a pressure surface and a suction surface extending between the leading edge and the trailing edge, the airfoil portion internally forming a cooling passage, wherein the cooling passage includes:

a first cooling passage located closer to the pressure surface than the suction surface;

a second cooling passage located closer to the suction surface than the pressure surface; and a plurality of outflow passages each having one end which opens to a merging portion formed by connecting an end portion of the first cooling passage on a side of the trailing edge and an end portion of the second cooling passage on the side of the trailing edge, and another end which opens to the trailing edge, wherein the first cooling passage and the second cooling passage are divided by a partition member which is a solid portion disposed in the airfoil portion, and wherein, only from an end portion of the partition member on the side of the trailing edge to a side of the leading edge, the cooling passage includes:

a plurality of pressure side pin fins each of which has one end connected to a pressure side wall including the pressure surface and another end connected to the partition member, in the first cooling passage; and a plurality of suction side pin fins each of which has one end connected to a suction side wall including the suction surface and another end connected to the partition member, in the second cooling passage.

2. The turbine blade according to claim 1, wherein a center line of each of the plurality of pressure side pin fins and a center line of any one of the plurality of suction side pin fins coincide with each other.

3. The turbine blade according to claim 1, wherein, from the side of the trailing edge toward the side of the leading edge, a pitch between adjacent pressure side pin fins is constant, as well as a pitch between adjacent suction side pin fins is constant.

4. The turbine blade according to claim 1, wherein the end portion of the partition member on the side of the trailing edge is located closer to the side of the trailing edge than both of a most downstream pressure side pin fin located closest to the side of the trailing edge among the plurality of pressure side pin fins and a most downstream suction side pin fin located closest to the side of the trailing edge among the plurality of suction side pin fins.

5. The turbine blade according to claim 4, wherein a center line of each of the plurality of pressure side pin fins and a center line of any one of the plurality of suction side pin fins coincide with each other, wherein, from the side of the trailing edge toward the side of the leading edge, a pitch between adjacent pressure side pin fins is constant, as well as a pitch between adjacent suction side pin fins is constant, and the both pitches are the same, and wherein $0.5P_2<P_1<2P_2$ holds, where $P_1$ is a pitch between the end portion of the partition member on the side of the trailing edge and the center lines of the most downstream pressure side pin fin and the most downstream suction side pin fin and $P_2$ is a pitch between the adjacent pressure side pin fins and a pitch between the adjacent suction side pin fins.

6. The turbine blade according to claim 1, wherein an outer diameter of each of the pressure side pin fins and an outer diameter of each of the suction side pin fins are different, or wherein, from the side of the trailing edge toward the side of the leading edge, a pitch between adjacent pressure side pin fins and a pitch between adjacent suction side pin fins are different.

7. The turbine blade according to claim 1, wherein the merging portion is defined by the end portion of the partition member on the side of the trailing edge and a passage inner surface facing the end portion, and wherein the end portion of the partition member on the side of the trailing edge and the passage inner surface each have a rounded shape.

8. The turbine blade according to claim 1, wherein a thickness of the suction side wall between the trailing edge and the end portion of the partition member on the side of the leading edge is larger than a thickness of the suction side wall between the leading edge and the end portion of the partition member on the side of the leading edge.

9. The turbine blade according to claim 1, wherein the airfoil portion is provided with a film hole which has one end opening to the cooling passage and another end opening to the pressure surface, and wherein an opening portion of the film hole opening to the cooling passage is located between the leading edge and an end portion of the partition member on the side of the leading edge.

10. A turbine blade comprising an airfoil portion which has a leading edge, a trailing edge, and a pressure surface and a suction surface extending between the leading edge and the trailing edge, the airfoil portion internally forming a cooling passage, wherein the cooling passage includes:

a first cooling passage located closer to the pressure surface than the suction surface;

a second cooling passage located closer to the suction surface than the pressure surface; and a plurality of outflow passages each having one end which opens to a merging portion formed by connecting an end portion of the first cooling passage on a side of the trailing edge and an end portion of the second cooling passage on the side of the trailing edge, and another end which opens to the trailing edge, wherein the first cooling passage and the second cooling passage are divided by a partition member which is a solid portion disposed in the airfoil portion, and wherein a suction side wall includes the suction surface, and a thickness of the suction side wall between the trailing edge and the end portion of the partition member on a side of the leading edge is larger than a thickness of the suction side wall between the leading edge and the end portion of the partition member on the side of the leading edge.

11. The turbine blade according to claim 10, wherein the airfoil portion is provided with a film hole which has one end opening to the cooling passage and another end opening to the pressure surface, and wherein an opening portion of the film hole opening to the cooling passage is located between the leading edge and an end portion of the partition member on the side of the leading edge.

12. A method for manufacturing a turbine blade that includes an airfoil portion which has a leading edge, a trailing edge, and a pressure surface and a suction surface extending between the leading edge and the trailing edge, the airfoil portion internally forming a cooling passage, the cooling passage including:

a first cooling passage located closer to the pressure surface than the suction surface;

a second cooling passage located closer to the suction surface than the pressure surface; and a plurality of outflow passages each having one end which opens to a merging portion formed by connecting an end portion of the first cooling passage on a side of the trailing edge and an end portion of the second cooling passage on the side of the trailing edge, and another end which opens to the trailing edge, the first cooling passage and the second cooling passage being divided by a partition member which is a solid portion disposed in the airfoil portion, and only from an end portion of the partition member on the side of the trailing edge to a side of the leading edge, the cooling passage including:

a plurality of pressure side pin fins each of which has one end connected to a pressure side wall including the pressure surface and another end connected to the partition member, in the first cooling passage; and a plurality of suction side pin fins each of which has one end connected to a suction side wall including the suction surface and another end connected to the partition member, in the second cooling passage, the method comprising:

a production step of producing the turbine blade; and a machining step of machining the plurality of outflow passages with respect to the airfoil portion, after the production step.

* * * * *